US010811017B2

(12) United States Patent
Law

(10) Patent No.: US 10,811,017 B2
(45) Date of Patent: Oct. 20, 2020

(54) TRANSPARENT LOSSLESS AUDIO WATERMARKING ENHANCEMENT

(71) Applicant: Malcolm Law, West Sussex (GB)

(72) Inventor: Malcolm Law, West Sussex (GB)

(73) Assignee: MQA Limited, London (GB)

( * ) Notice: Subject to any disclaimer, the term of this patent is extended or adjusted under 35 U.S.C. 154(b) by 132 days.

(21) Appl. No.: 16/065,920

(22) PCT Filed: Dec. 22, 2016

(86) PCT No.: PCT/GB2016/054037
§ 371 (c)(1),
(2) Date: Jun. 25, 2018

(87) PCT Pub. No.: WO2017/109498
PCT Pub. Date: Jun. 29, 2017

(65) Prior Publication Data

US 2019/0019523 A1 Jan. 17, 2019

(30) Foreign Application Priority Data

Dec. 23, 2015 (GB) ..... 1522816.6

(51) Int. Cl.
*G10L 19/018* (2013.01)
*G10L 19/00* (2013.01)
*G10L 19/032* (2013.01)

(52) U.S. Cl.
CPC ..... *G10L 19/018* (2013.01); *G10L 19/0017* (2013.01); *G10L 19/032* (2013.01)

(58) Field of Classification Search
CPC ..... G10L 19/018
USPC ..... 704/500
See application file for complete search history.

(56) References Cited

U.S. PATENT DOCUMENTS 6,061,793 A * 5/2000 Tewfik ..... G10L 19/02 375/E7.167
7,663,527 B2 * 2/2010 Van Der Veen ..... H04N 19/124 341/200
7,940,954 B2 * 5/2011 Horvatic ..... G10L 19/018 382/100

(Continued)

FOREIGN PATENT DOCUMENTS

EP 2544179 A1 9/2013
GB 2495918 A 1/2013

(Continued)

OTHER PUBLICATIONS

"Combined Search and Examination Report under Sections 17 and 18(3)" for GB Application No. GB1522816.6 dated Jun. 17, 2017, 5 pp.

(Continued)

*Primary Examiner* — Susan I McFadden
(74) *Attorney, Agent, or Firm* — Buckley, Maschoff & Talwalkar LLC

(57) ABSTRACT

Methods and devices are described for losslessly watermarking an audio signal by performing a noise shaped quantisation and clipping the output from the noise shaped quantisation to bounds computed by a pair of quantised linear functions with gradient 0.5 of the input to the noise shaped quantisation. Corresponding methods and devices are also described for inverting the process to recover an exact replica of the original audio signal.

20 Claims, 5 Drawing Sheets

(56) References Cited

U.S. PATENT DOCUMENTS

| | | | | |
|---|---|---|---|---|
| 8,676,364 | B2 * | 3/2014 | Scharrer | G10L 19/008 341/101 |
| 9,424,853 | B2 * | 8/2016 | Scharrer | G10L 19/008 |
| 9,858,681 | B2 * | 1/2018 | Rhoads | G06T 7/579 |
| 9,940,940 | B2 * | 4/2018 | Craven | G10L 19/018 |

FOREIGN PATENT DOCUMENTS

| | | | |
|---|---|---|---|
| GB | 2524784 | A | 7/2015 |
| WO | WO2015/150746 | A1 | 10/2015 |

OTHER PUBLICATIONS

"International Search Report and Written Opinion" for PCT Application No. PCT/GB2016/054037 dated Feb. 10, 2017, 12 pp.

* cited by examiner

TRANSPARENT LOSSLESS AUDIO WATERMARKING ENHANCEMENT

CROSS-REFERENCE TO RELATED APPLICATIONS

This application is a U.S. National Stage filing under 35 U.S.C. § 371 and 35 U.S.C § 119, based on and claiming priority to PCT/GB2016/054037 for "TRANSPARENT LOSSLESS AUDIO WATERMARKING ENHANCEMENT" filed Dec. 22, 2016 and claiming priority to GB Application No. 1522816.6 filed Dec. 23, 2015.

FIELD OF THE INVENTION

The invention relates to the watermarking of audio signals, and particularly to improved transparency of the watermarking and recovery of the original audio signal.

BACKGROUND TO THE INVENTION

WO2015150746A1 describes a method of watermarking an audio signal such that the watermarked audio is a high fidelity version of the original and the watermark can be completely removed restoring an exact replica of the original audio signal.

With reference to FIG. 1A of WO2015150746A1, which is duplicated here as FIG. 1A, the known method employs a clip unit 133 which ensures that signal 104 respects known bounds, followed by a noise shaped quantiser that buries data 143 comprising control data 141 and watermark data to generate the output signal 102. FIG. 1B shows the corresponding decoding signal flow from WO2015150746A1.

FIG. 1C illustrates a simplified model of the encoding signal flow of FIG. 1A with everything up to generating signal 104 lying on a quantisation grid $O_3$ shown as Preprocessing and the remainder of the apparatus as being a Data Burier 114, which adds noise to produce an output 102 on a quantisation grid $O_2$. Thus, the audio signal is subject to some pre-processing, producing a signal 104 that is clipped to known bounds. The Data Burier 114 then adds data-dependent noise of known peak magnitude to produce the output signal 102 on a quantisation grid $O_2$. The noise is dependent on the data 143 to be buried, which comprises watermark data and additional data 141 produced by the Preprocessing.

FIG. 1D illustrates a simplified model of the decoding signal flow of FIG. 1B in a similar manner. The input signal 202 (intended to be a replica of the output 102 from the encoder of FIG. 1C) is fed through an Extractor 214 which inverts the operation of the Burier 114 to produce a signal 204 replicating signal 104. Further post-processing inverts the encoder pre-processing. FIG. 1D shows illustrative internals for how the Extractor may invert the Burier, by inspection of the watermarked signal it extracts data 243 which replicates 143. It can now generate and subtract the same noise as the Burier added.

However, there is a problem that in order to ensure the output signal 102 does not overload, signal 104 must be clipped to tighter bounds to allow for the noise added in the data burying unit.

The tighter bounds do not degrade transparency on real audio, but it is common practice to evaluate a system's performance on test signals including full level sine waves. Clipping full level sine waves causes visible distortion products on test equipment and to avoid criticism of the system fidelity there is a need to minimise the level of these distortion products.

SUMMARY OF THE INVENTION

According to a first aspect of the present invention there is provided a method for losslessly watermarking an audio signal comprising the steps of:

performing a noise shaped quantisation; and, clipping the output from the noise shaped quantisation to bounds computed by a pair of quantised linear functions with gradient 0.5 of the input to the noise shaped quantisation.

In this way, the present invention enhances the transparency of the technique described in WO2015150746A1 on full scale test material whilst preserving the ability to exactly invert the watermarking operation and recover a perfect replica of the original audio signal.

The invention broadly achieves this by:

(i) allowing input 104 to the data burier to attain the peak representable values;

(ii) dealing with overload introduced by the Burier by clipping the watermarked signal to bounds that are quantised linear functions of the input to the noise shaped quantiser where the quantisation ensures that the bounds convey the same watermarking information as the signal and the linear functions have gradient 0.5;

(iii) inspecting the input 104 to the data burier and producing an additional bit of reconstitution data when it is close to the peak representable value, which allows the decoder to resolve the ambiguity introduced by the less than unity gradient of 0.5

According to a second aspect of the present invention there is provided a method for processing a losslessly watermarked audio signal comprising the steps of:

performing a noise shaped quantisation on the audio signal; and, selecting the middle value from the triple consisting of the output from the noise shaped quantisation and a pair of quantised linear functions of the audio signal with gradient 2.

According to a third aspect of the present invention there is provided an encoder adapted to losslessly watermark an audio signal using the method of the first aspect.

According to a fourth aspect of the present invention there is provided a decoder adapted to process a losslessly watermarked audio signal using the method of the second aspect.

According to a fifth aspect of the present invention there is provided a codec comprising an encoder according to the third aspect in combination with a decoder according to the second aspect.

According to a sixth aspect of the present invention there is provided a data carrier comprising an audio signal losslessly watermarked using the method of the first aspect.

According to a seventh aspect of the present invention there is provided a computer program product comprising instructions that when executed by a signal processor causes said signal processor to perform the method of the first or second aspect.

As will be appreciated by those skilled in the art, the present invention provides techniques and devices for enhancing the transparent lossless watermarking of audio signals, whilst enabling inversion of the watermarking operation for recovering a perfect replica of the original audio. Further variations and embellishments will become apparent to the skilled person in light of this disclosure.

BRIEF DESCRIPTION OF THE DRAWINGS

Examples of the present invention will be described in detail with reference to the accompanying drawings, in which.

DETAILED DESCRIPTION

The need for the invention arises from the invertibility requirement. Without it, any form of clip that preserved the watermark could be performed on the watermarked signal.

Notation

We use the expression [a, b] to mean the closed interval between a and b which includes both endpoints a and b. The expression [a, b) means the semi-open interval between a and b which includes a but not b.

We use Δ to mean the quantisation stepsize of the audio, and use L (which we assume is even) to denote the limit on sample values on the encoder output 105 as [−LΔ, +LΔ). We refer to ±LΔ as the peak representable values.

When we refer to the lsb of an audio value x we mean (floor(x/Δ) modulo 2) where floor(y) is the greatest integer not exceeding y.

We use k for the peak level of noise added in the Burier 114, such that values of noise lie in the range [−kΔ, +kΔ]. We require k to be integer, so it refers to the rounded up peak level of noise.

Introductory Embodiment

Figure 1A:
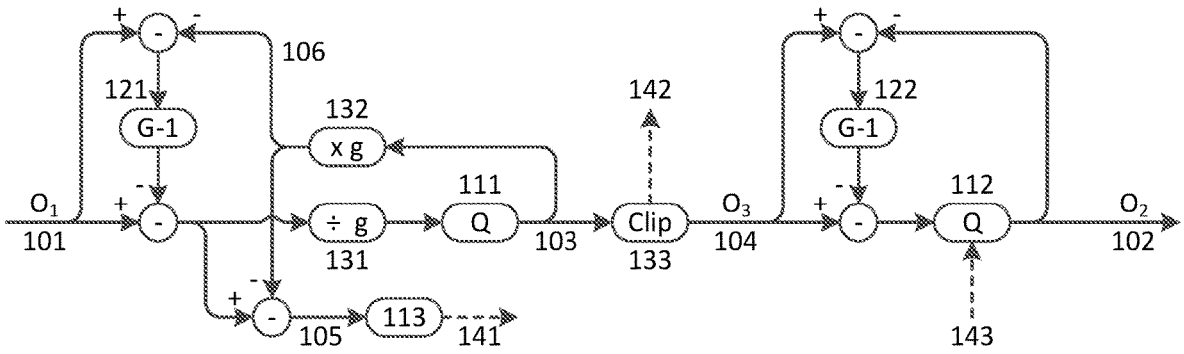
Fig. 1A (Prior Art)
FIG. 1A shows a signal flow diagram of a known encoder for transparent lossless audio watermarking.
Figure 1B:
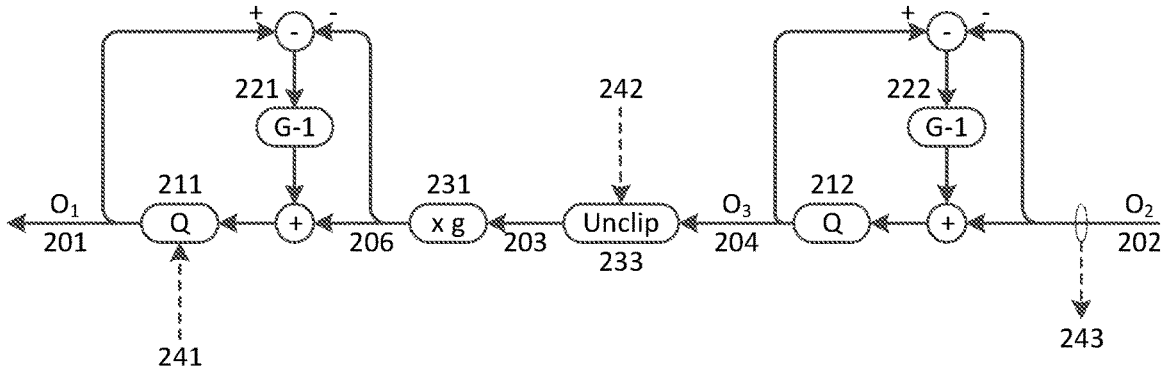
Fig. 1B (Prior Art)
FIG. 1B shows a signal flow diagram of a known decoder corresponding to the encoder of FIG. 1A.
Figure 1C:
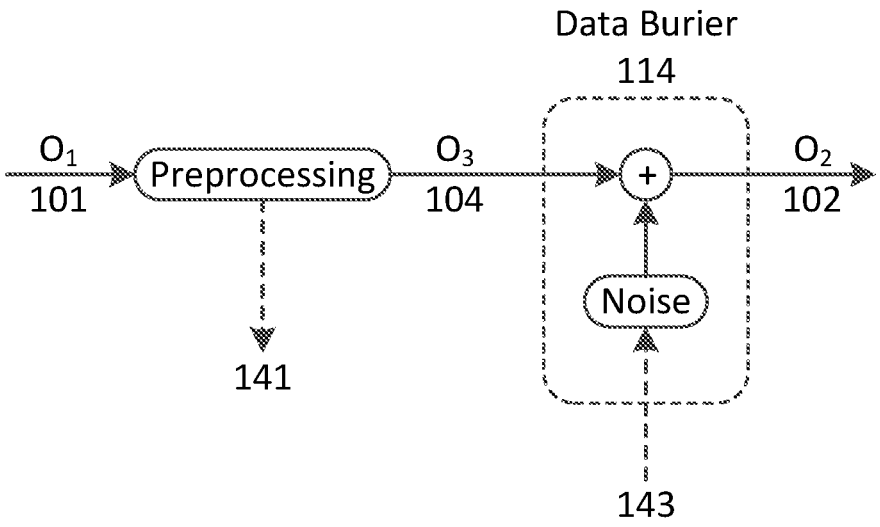
Fig. 1C (Prior Art)
FIG. 1C shows a simplified model of the signal flow diagram of FIG. 1A.

We first describe an embodiment of the invention suited to use when signals 104 and 102 in FIG. 1C are integer multiples of Δ. This is not a particularly useful embodiment, since the constraint rules out the watermarking method of WO2015150746, but it allows us to introduce the essential features of the invention before dealing with added complexity.

Figure 2:
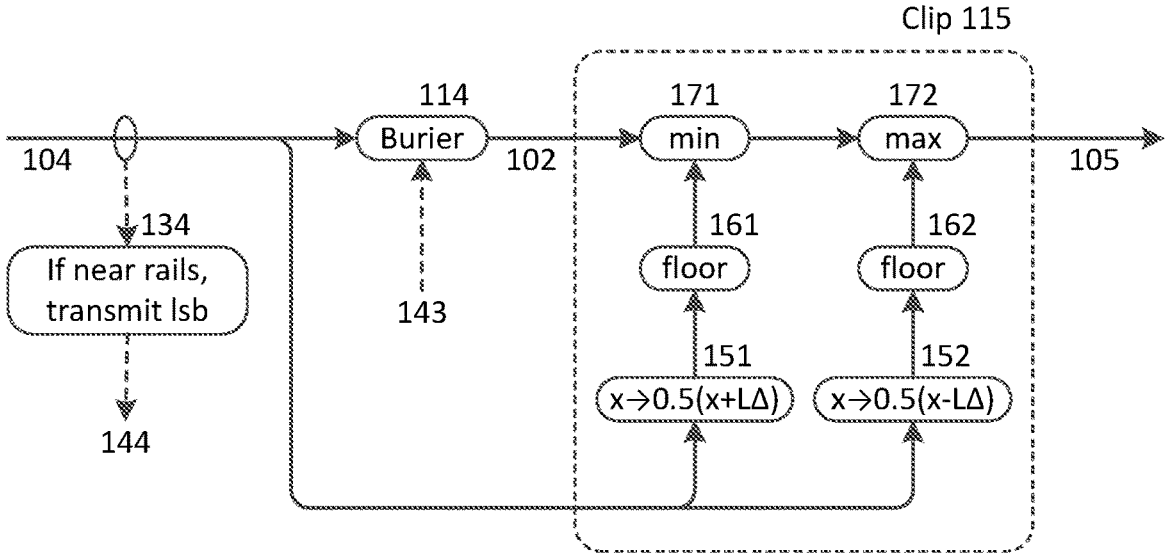
FIG. 2 shows an encoder according to an embodiment of the invention, which adds an Inspector and a Clip unit around the Burier in FIG. 1C.

FIG. 2 shows an encoder according to the invention, which adds two elements around the Burier 114. Firstly, an Inspector 134 which transmits the lsb of the audio as data 144 if the audio is near the peak representable values ±LΔ. Secondly, a Clip unit 115 where the clipping (implemented by minimum operation 171 and maximum operation 172) clips to limits derived from the input 104 to the Burier 114 by linear functions 151 and 152 and quantisers 161 and 162.

Signal 104 exercises the full range [−LΔ, +LΔ), and so since the Burier 114 adds noise, its output signal 102 may exceed this range. Consequently, action needs to be taken to ensure that signal 105 lies inside the range [−LΔ, +LΔ). Clipper 115 takes this action.

Clipping however removes information from the audio stream, as it maps a number of input sample values around the clip point to fewer output sample values. There needs to be a side path for this lost information, and that is provided by Inspector 134 which inspects the audio data and, if required, transmits data 144 that will allow the decoder to reconstitute the original signal despite the loss of information inherent in clipping.

Ideally this data 144 would precisely convey the information discarded in clipping, and so would only be sent when Clipper 115 produces ambiguity. However, this is impractical because the only channel available to pass data across to the decoder is by multiplexing it into data 143, and (as shown in FIG. 1C) the noise added by the Burier 114 and consequently whether clipping actually occurs on any particular occasion depends on data 143. Due to this circularity, data 144 needs to be transmitted whenever signal 104 (which does not depend on data 143) indicates that clipping might possibly occur.

Under these circumstances, it is data efficient to arrange that the Clipper 115 is designed such that 1 bit of data suffices to resolve whatever ambiguity arises and so the Inspector transmits the lsb of the audio whenever signal 104 is sufficiently close to +LΔ that the decoder might require the data to resolve ambiguity. We will address what sufficiently close means later.

Moving on to explain the design of the Clipper 115, since the decoder is being supplied with at most one bit to resolve ambiguity, the clipper must ensure that no output value 105 is mapped to by more than two values of signal 104. We also desire that the clipping should minimise its modification to the signal. Therefore, considering the positive clip point, we would like the largest two possible values of signal 104 to map to the largest value of signal 105 and the next two largest possible values to map to the next largest value of signal 105, and so on until there is no further need for clipping below which the clipper does not modify the signal.

This is exactly what Clipper 115 implements. In this embodiment the transfer function of 161 and 162 is Q(x)=Δ floor(x/Δ) and the linear functions 151 and 152 map x to 0.5(x+LΔ) and 0.5(x−LΔ) respectively. The positive clip point is effected by minimum operation 171 which clips signal 102 to a quantised linear function of signal 104. Looking at linear function 151, the gradient of 0.5 ensures that two values of signal 104 map to each value of signal 105 whilst the offset of 0.5LΔ ensures that the largest two value of signal 104 map to the largest possible value of signal 105. And finally the minimum operation 171 ensures that we stop mapping two values of signal 104 to every value of signal 105 when there is no further need for clipping.

Figure 3:
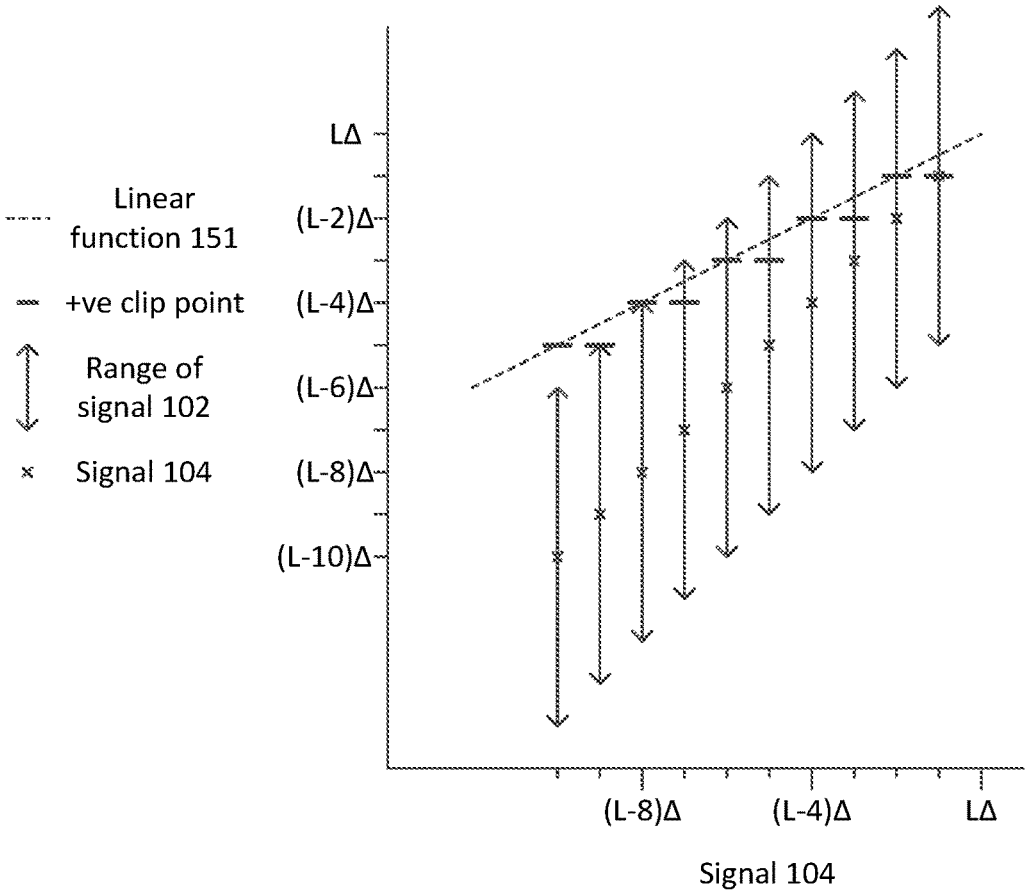
FIG. 3 illustrates possible signal values in the region of the positive clip limit LΔ.

This is illustrated in FIG. 3, which shows the possible signal values in the region of the positive clip limit LΔ. For near peak values of signal 104, we plot the output of the linear function 151 and the positive clipping point implemented by min operation 171. We also show an illustrative range of values signal 102 can take, due to the noise introduced in the data burier 114.

Thus FIG. 3 shows the range of signal 102 (for an illustrative k=4), the output of linear function 151 and the clip point after quantisation 161. As signal 104 varies, values away from +LΔ mean no signal modification whatever Burier 114 does. As signal 104 increases, the larger +ve values of noise lead to clipping until for the largest possible signal 104 all positive values of noise lead to clipping. Whatever the instantaneous level of noise added by Burier 114, there are at most two values of signal 104 which lead to any output value 105, and so one bit of side channel data 144 suffices for resolving ambiguity.

The negative clip point is implemented by maximum operation 172, linear function 152 and quantiser 162 with similar properties as for the positive clip point.

Having discussed the form of the Clipper 115, we can now return to define "sufficiently close" in Inspector 134. The smallest value of signal 104 which might altered by +ve clipping is (L−2k+1)Δ and that clipping might lead it to generate the same output as (L−2k)Δ. Similarly, the largest value that might be affected by −ve clipping is (−L+2k−2)Δ, which may generate the same output as (−L+2k−1)Δ. Consequently, Inspector 134 transmits the lsb whenever signal 104 $\notin$[−LΔ+2kΔ, LΔ−2kΔ).

In this computation it is not necessary to use the exact value of k, a larger value would still give correct operation just at a slightly higher data cost (since the lsb may be transmitted when ambiguity could never arise). However, computational convenience outweighing the data cost, may possibly arise from using a power of 2. In this case a larger guard band may be used, perhaps up to 4kΔ.

Figure 1D:
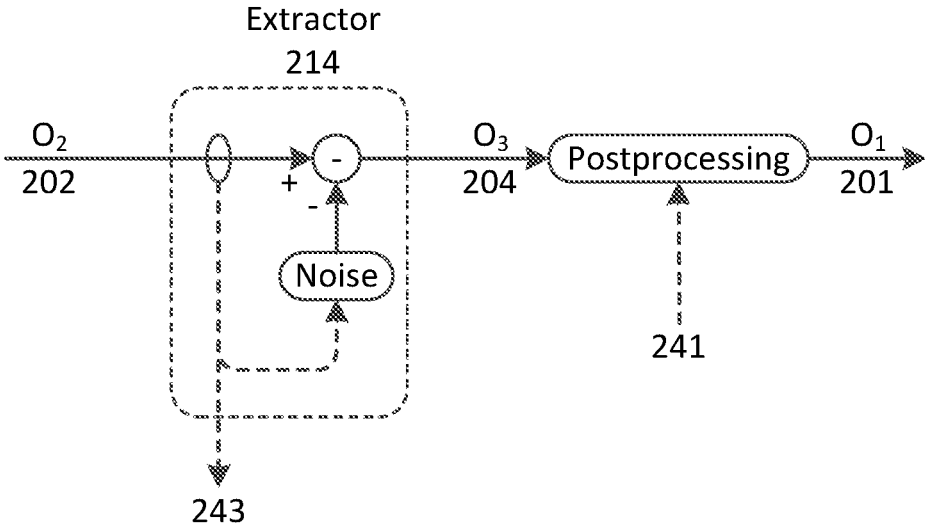
Fig. 1D (Prior Art)
FIG. 1D shows a simplified model of the signal flow diagram of FIG. 1B.
Figure 4:
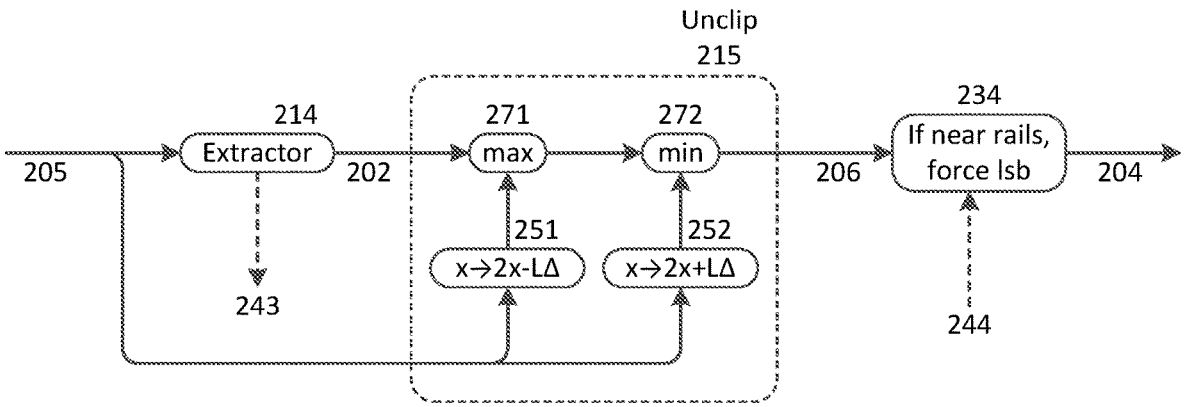
FIG. 4 shows a decoder according to an embodiment of the invention corresponding to the encoder of FIG. 2, which adds an Unclip unit and an Lsb forcing unit to the decoder of FIG. 1D.

FIG. 4 shows the corresponding decoder to the encoder of FIG. 2, which adds an Unclip unit 215 and an Lsb forcing unit 234 to the decoder of FIG. 1D. The Unclip unit 215 approximately inverts any signal modification made by the encoder Clip unit 115, and the Lsb Forcer completes the inversion using supplementary data 244 to force the lsb of the audio.

Thus, similarly to the encoder, the Extractor 214 of FIG. 1D is augmented by an Unclip 215 and Lsb Forcer 234 (driven by data 244 demultiplexed from data 243 extracted by Extractor 214). Together they invert any signal modification made by Clip 115 and so signal 204 is a lossless replica of signal 104 in the encoder.

To see this, let us first consider operation around the positive clip limit +LΔ. Linear function 251 and 252 are the inverse mappings to linear function 151 and 152 in the encoder and map x to 2(x−LΔ) and 2(x+LΔ) respectively.

If the encoder clipped, then signal 105 was equal to the output from quantiser 161, which in turn is equal to 0.5(x+LΔ)−ε, where we denote signal 104 as x and the modification from the quantiser 161 as ε (which is either 0 or 0.5Δ).

The output from linear function 251 can be computed as 2(0.5(x+LΔ)−ε)−LΔ=x−2ε, which is an even multiple of Δ and either x or x−Δ.

Since the encoder clipped, we know that signal 102>signal 105. Since signal 205 replicates signal 105 and extractor 214 subtracts the same noise as added by burier 114, this implies that signal 104>signal 202 and so signal 202 signal 104−Δ=x−Δ. Consequently, the max operation 271 ensures that signal 206 is equal to the output of linear function 251 and so signal 206 is an even multiple of Δ and either x or x−Δ. Restoring the lsb in 234 then ensures that signal 204 replicates signal 104.

If the encoder did not clip, then maximum operation 271 has no effect and signal 206 replicates signal 104. Forcing the lsb to the correct value (if it happens in 234) has no effect on the signal and signal 204 also replicates signal 104 as required. Similarly, it can be seen that operations 252, 272 and 234 invert any clipping to the negative bound that happened in the encoder and are of no effect otherwise.

The one remaining issue to consider is the data consumption of Lsb Forcer 234. This consumes a bit of data and forces the lsb if signal 206 is "near the rails", and we use the same definition of "near the rails" as in Inspector 134. Since signal 206 does not always quite replicate signal 104, the definition of "near the rails" is chosen to ensure that the decision point between transmitting the bit and not transmitting it lies in the region where signal 206 does replicate signal 104.

Quantisation Grids

In a second embodiment of the invention, the signals are defined to lie on quantisation grids, as discussed in WO2015150746A1. They are offset from being integer multiples of Δ by an offset which may vary from sample to sample.

Signals 104, 202, 204, 206 and the outputs of quantisers 261 and 262 all lie on the same quantisation grid which we call $O_3$ for compatibility with WO2015150746A1. Signal 102, 105 and 205 all lie on another quantisation grid $O_2$. Grid $O_3$ could be identically zero (corresponding to no offset) but would usually be defined by a pseudo-random sequence synchronised between the encoder and decoder. Grid $O_2$ depends on the data 143 and is the mechanism described in WO2015150746A1 for watermarking the audio. We normalise offsets defining quantisation grids to lie in the range [0, Δ).

Figure 5:
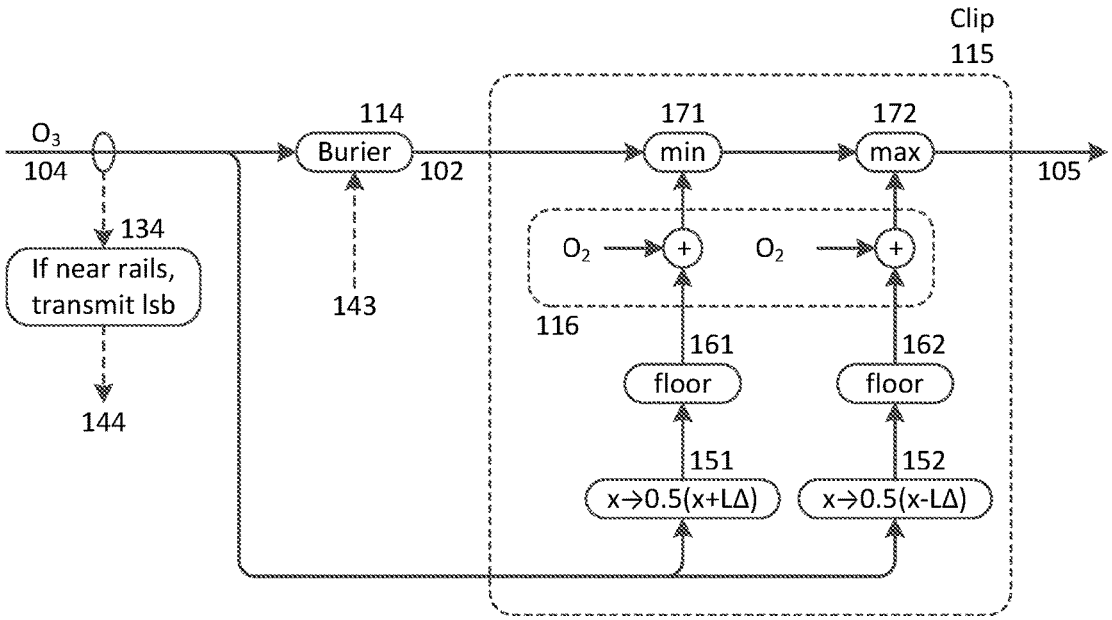
FIG. 5 shows an encoder according to a second embodiment of the invention.

An encoder according to the second embodiment is shown in FIG. 5, where Offseter 116 ensures that Clip 115 does not alter the watermark. The offset $O_3$ on signal 104 does not actually affect the output of quantisers 161 or 162, it just increases ε by $0.5O_3$. However, we need to ensure that Clip 115 preserves the watermark (i.e. signal 105 still lies on $O_2$ when clipping occurs). This is done by Offseter 116, which adds the offset $O_2$ to the outputs of quantisers 161 and 162.

The encoder knows $O_2$, but it could be computed by subtracting from signal 102 a quantised version of itself if desired.

Figure 6:
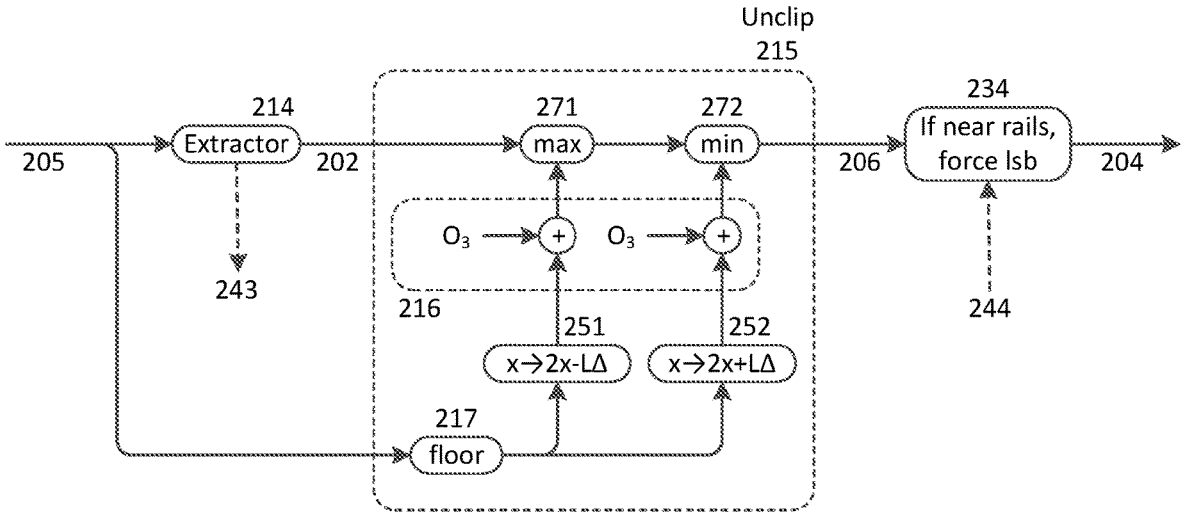
FIG. 6 shows a decoder according to a second embodiment of the invention corresponding to the encoder of FIG. 5; and, FIG. 7 illustrates the signal flow for disabling noise shaping when clipping occurs in a fourth embodiment of the invention.

A corresponding decoder according to a second embodiment of the invention is shown in FIG. 6. Quantiser 217 removes offset $O_2$ from the signal presented to the linear functions 251 and 252 and Offseter 216 adds offset $O_3$ to their output so that it lies on the required grid. Thus, quantiser 217 compensates for Offseter 116 in the encoder and Offseter 216 ensures that signal 206 lies on the correct quantisation grid.

Vector Quantisation

In a third embodiment of the invention, signals on quantisation grids $O_2$ and $O_3$ are vector quantised as suggested in WO2015150746A1, which discusses a quantisation lattice defined by $\{[2^{-16}, 2^{-16}], [2^{-16}, -2^{-16}]\}$.

In this embodiment, we would like the clip to operate monophonically so that one channel clipping does not affect the other. This can be done by defining Δ to be the smallest distance between lattice points on each channel. In this case $[2^{-15}, 0]=[2^{-16}, 2^{-16}]+[2^{-16}, -2^{-16}]$ and $[0, 2^{-15}]=[2^{-16}, 2^{-16}]-[2^{16}, -2^{-16}]$ so we can define $\Delta=2^{-15}$ for each channel. This is a slight abuse of our definition of Δ as the quantisation stepsize of the audio but it does make everything work monophonically as intended.

The only slight exception is that the offsets added by the Offseters 116 and 216 need to take into account the parity of the other channel as well as the quantisation grids $O_2$ or $O_3$. The correct offsets are however given by subtracting signals 102 and 202, respectively, from a quantised version of themselves for use in the Offseters.

Disabling Noise Shaping

In a fourth embodiment of the invention, we note that the Burier 114 is actually implemented by a noise-shaped quantiser (i.e. quantiser 112 and filter 112 in FIG. 1A).

When clipping is in operation, it makes instantaneous changes to signal 105 which are not noise shaped. We do not attempt to noise shape these changes, but their presence makes it pointless to noise shape the smaller (and not necessarily of the same polarity) error committed by quantiser 112.

Figure 7:
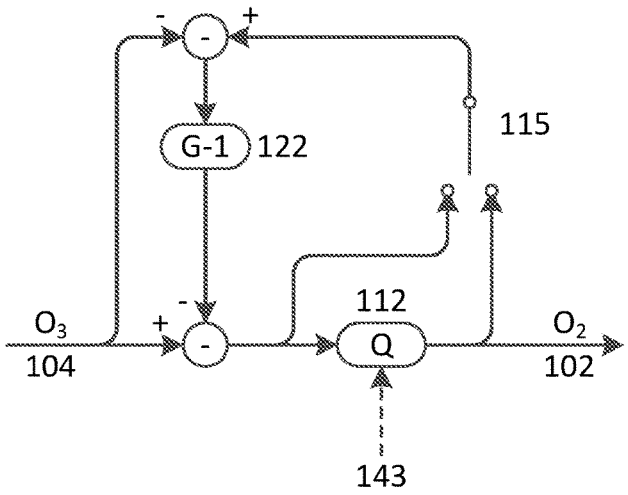

Accordingly in a fourth embodiment of the invention, we disable noise shaping in the encoder Burier 114, as shown in FIG. 7, where multiplexor 115 normally feeds back the output of quantiser 112 but instead feeds back its input when clipping occurs. Thus, multiplexor 115 selects whether to shape (in the right hand position) or not shape (in the left hand position) the error committed by quantiser 112.

Likewise the feedback is altered in the decoder Extractor 214 in a synchronised manner.

The decoder does not categorically know if clipping has occurred until operation 234 has concluded, allowing it to compare signals 202 and 204. This is likely to be inconvenient to implement, so preferably the decoder decides to disable feedback on the basis of signal 206 instead. To maintain synchronisation between encoder and decoder, the encoder must operate in lockstep which it can do by simulating the decoder signal 206 and applying the same logic.

Well Defined Digital Signature

In a fifth embodiment of the invention, it is desired for the decoder to authenticate the stream by verifying a digital signature of the audio conveyed in the datastream 243.

It is preferred that the audio over which the signature is computed is independent of the buried data 143, but also that it can be accessed early in the decode process to minimise the computational load of only performing authentication without decode. Signal 206 presents a good point for the authentication, but at that point the lsb of the audio is ill-defined if clipping might or might not have happened.

Accordingly, in a fifth embodiment of a decoder according to the invention, an audio stream is created for verifying a digital signature by forcing the lsb of signal 206 when the audio is near the rails. This is just like Lsb Forcer 234, except that it does not consume data but forces the lsb to a conveniently chosen value (eg clears it) instead.

Correspondingly, in a fifth embodiment of an encoder according to the invention, an audio stream is created for computing a digital signature by forcing the lsb of signal 104 when the audio is near the rails.

Arithmetic Notes

The arithmetic for performing the clip and unclip operations can be rearranged in many ways. For example, instead of performing max/min operations 171, 172, 271 and 272 an adjustment could be computed (which is normally zero but is an integer multiple of Δ when clipping is to occur) and added to signals 102 or 202.

Clipping to the calculated bounds is equivalent to selecting the middle of 3 signals (102 and the outputs of Offseter 116). Less obviously the decoder unclipping is also selecting the middle of 3 signals (202 and the outputs of Offseter 216).

Neither clipping nor unclipping necessarily need computation of both linear functions. For example, when dealing with positive values, clearly the linear functions that affect operation around $-L\Delta$ are not going to alter the signal and vice versa for negative values.

The invention claimed is:

1. A method for losslessly watermarking an audio signal comprising the steps of:

performing a noise shaped quantisation; and, clipping the output from the noise shaped quantisation to bounds computed by a pair of quantised linear functions with gradient 0.5 of the input to the noise shaped quantisation.

2. A method according to claim 1, wherein the clipping does not alter the watermark.

3. A method according to claim 1, wherein the step of noise shaped quantisation buries watermark data in the audio signal, such data comprising data indicating the least significant bit (lsb) of the audio presented to the noise shaped quantisation whenever said audio is within a constant amount K of the peak representable values, wherein the lsb of an audio value x denotes floor(x/Δ) modulo 2, where Δ is the smallest distance between lattice points of a quantisation grid on a channel to which the noise shaped quantisation is performed.

4. A method according to claim 3, where K is not less than twice the peak level of alteration that the noise shaped quantisation might introduce.

5. A method according to claim 3, wherein K is less than four times the peak level of alteration that the noise shaped quantisation might introduce.

6. A method according to claim 3, further comprising the step of computing a digital signature over data comprising audio derived from the input to the noise shaped quantisation by forcing the lsb to standardised values whenever the audio lies within a constant M of the peak representable values.

7. A method according to claim 6, wherein M is not less than twice the peak level of alteration that the noise shaped quantisation might introduce.

8. A method according to claim 6, wherein M is less than four times the peak level of alteration that the noise shaped quantisation might introduce.

9. A method according to claim 1, wherein quantisation errors arising on samples of the audio signal that are altered by the clipping are excluded from spectral shaping in the step of noise shaped quantisation.

10. A non-transitory computer readable medium comprising instructions that when executed by a signal processor causes said signal processor to perform a method comprising:

performing a noise shaped quantisation; and, clipping the output from the noise shaped quantisation to bounds computed by a pair of quantised linear functions with gradient 0.5 of the input to the noise shaped quantisation.

11. A method for processing a losslessly watermarked audio signal comprising the steps of:

performing a noise shaped quantisation on the audio signal; and, selecting the middle value from the triple consisting of the output from the noise shaped quantisation and a pair of quantised linear functions of the audio signal with gradient 2.

12. A method according to claim 11, further comprising the step of forcing the least significant bit (lsb) of the middle value to a forced value whenever it is within a constant amount K of the peak representable values, such forced values being dependent on the audio watermark, wherein the lsb of an audio value x denotes floor(x/Δ) modulo 2, where Δ is the smallest distance between lattice points of a quantisation grid on a channel to which the noise shaped quantisation is performed.

13. A method according to claim 12, wherein K is not less than twice the peak level of alteration that the noise shaped quantisation might introduce.

14. A method according to claim 12, wherein K is less than four times the peak level of alteration that the noise shaped quantisation might introduce.

15. A method according to claim 12, wherein quantisation errors arising on samples of the audio signal where said forced lsb value differs from the lsb of the output of the noise shaped quantisation are excluded from spectral shaping in the step of noise shaped quantisation.

16. A method according to claim 12, further comprising the step of verifying a digital signature computed over data comprising audio derived from said middle value by forcing its lsb to standardised values whenever said middle value lies within a constant M of the peak representable values.

17. A method according to claim 16, wherein M is not less than twice the peak level of alteration that the noise shaped quantisation might introduce.

18. A method according to claim 16, wherein M is less than four times the peak level of alteration that the noise shaped quantisation might introduce.

19. A method according to claim 11, wherein quantisation errors arising on samples of the audio signal where said selected middle value differs from the output of the noise shaped quantisation are excluded from spectral shaping in the step of noise shaped quantisation.

20. An encoder adapted to losslessly watermark an audio signal by executing a process, the process comprising:

performing a noise shaped quantisation; and, clipping the output from the noise shaped quantisation to bounds computed by a pair of quantised linear functions with gradient 0.5 of the input to the noise shaped quantisation.

* * * * *